US007076824B2

(12) United States Patent
Steidle

(10) Patent No.: US 7,076,824 B2
(45) Date of Patent: Jul. 18, 2006

(54) METHOD OF MANUFACTURING A MASK SLIPPER

(75) Inventor: William Steidle, New York, NY (US)

(73) Assignee: Wiesner Products, Inc., New York, NY (US)

( * ) Notice: Subject to any disclaimer, the term of this patent is extended or adjusted under 35 U.S.C. 154(b) by 158 days.

(21) Appl. No.: 10/792,071

(22) Filed: Mar. 3, 2004

(65) Prior Publication Data

US 2005/0193505 A1 Sep. 8, 2005

(51) Int. Cl.
*A43D 11/00* (2006.01)
*A43B 19/02* (2006.01)

(52) U.S. Cl. ..... 12/142 A; 36/19 R; 36/112

(58) Field of Classification Search ..... 36/19 A, 36/19 R, 17 A, 112; 12/142 A
See application file for complete search history.

(56) References Cited

U.S. PATENT DOCUMENTS

| | | | | | |
|---|---|---|---|---|---|
| D78,569 | S | * | 5/1929 | Goldberg | D2/976 |
| D82,434 | S | * | 11/1930 | Klauer | D2/899 |
| 1,823,634 | A | * | 9/1931 | Wiesner | 36/102 |
| 1,909,645 | A | * | 5/1933 | Wiesner | 36/102 |
| 2,016,788 | A | * | 10/1935 | Naidor | 36/19 A |
| 2,160,756 | A | * | 5/1939 | Schreck | 36/112 |
| 2,389,554 | A | * | 11/1945 | Schwartz | 36/102 |
| 2,798,311 | A | * | 7/1957 | Scholl | 36/10 |
| 3,023,420 | A | * | 3/1962 | Rosabelle | 2/239 |
| 4,620,495 | A | * | 11/1986 | Ganon | 112/320 |
| 4,899,412 | A | * | 2/1990 | Ganon | 12/142 A |
| 5,012,541 | A | * | 5/1991 | Ganon | 12/142 G |
| 5,381,610 | A | * | 1/1995 | Hanson | 36/100 |
| 5,491,860 | A | * | 2/1996 | Bray et al. | 12/142 A |
| 6,276,074 | B1 | * | 8/2001 | Martin | 36/100 |
| 6,898,973 | B1 | * | 5/2005 | Schenone | 36/112 |
| 2004/0148805 | A1 | * | 8/2004 | Hayes | 36/112 |

* cited by examiner

*Primary Examiner*—Ted Kavanaugh
(74) *Attorney, Agent, or Firm*—Ezra Sutton, Esq.

(57) ABSTRACT

A method of making a mask slipper, comprising the steps of forming a mask from a material selected from the group consisting of plastic, latex and fabric; forming a composite sole member having a first layer of inner filler material; forming a composite upper member having a second layer of inner filler material, an outer surface for receiving the mask, and an inner surface for receiving an inner lining. The method of making the mask slipper further composes the steps of attaching said mask to said outer surface of the composite upper member; attaching the inner lining to the inner surface of the composite upper member; attaching the composite sole member to the composite upper member to form the mask slipper; and turning of the mask slipper such that a correct outer side is on the outside of the formed mask slipper.

6 Claims, 8 Drawing Sheets

METHOD OF MANUFACTURING 100 OF THE MASK SLIPPER 10

METHOD OF MANUFACTURING 100 OF THE MASK SLIPPER 10 CONTINUED

METHOD OF MANUFACTURING A MASK SLIPPER

FIELD OF THE INVENTION

The present invention relates to a method of manufacturing a mask slipper. More particularly, the method includes the step of attaching a three-dimensional, molded latex facial mask to the top of a slipper. The latex mask may take the form of a variety of characters such as an animal, a human, a cartoon animation, an insect, a bird, a fish and the like.

BACKGROUND OF THE INVENTION

Slippers and methods of manufacturing such slippers are well known in the art. Further, ornaments to various types of clothing and footwear are also known in the art.

There remains a need for an easy and inexpensive method of manufacturing a mask slipper wherein an outer latex layer, which forms a mask, is attached to an upper foot section of the mask slipper.

DESCRIPTION OF THE PRIOR ART

Slippers having various designs, structures, configurations, materials of construction and methods of manufacturing have been disclosed in the prior art. For example, U.S. Pat. No. 4,324,054 to ROVINSKY discloses a flexible child's slipper which has a night light associated therewith which may be selectively actuated by each step of the child as the sock flexes with each step. The night light includes a hollow transmissive three dimensional character rendition which contains an illumination apparatus inside. This prior art patent does not disclose or teach the method of manufacturing the mask slipper of the present invention.

U.S. Pat. No. 5,058,293 to VILLAR discloses novel footwear in which the upper front portion has an animated face with movable eyes. The footwear comprises an inner sole, an outer sole, and an upper shoe surface affixed together in a wearable relationship, with an arch-shaped support member located in a forward interior portion of the footwear. The upper portion of the arch is in contact with the interior of the upper shoe surface, and its opposite lower edges are affixed to edge portions of the outer sole. The eye members are rotated each time the foot of the user presses down on a treadle member. This prior art patent does not disclose or teach the method of manufacturing the mask slipper of the present invention.

U.S. Pat. No. 6,189,240 to COWGILL et al. discloses a novel shoe embodying a caricature of the head of an animal including a sole and an upper which cooperate to form a foot-receiving compartment there between. The sole and the upper are configured such that a mouth of the caricature defines an entry for the foot-receiving compartment. A first portion of the upper is attached to the sole and forms a lower jaw of the caricature. A second portion of the upper extends from the toe and forms an upper jaw of the caricature. The upper second portion articulates relative to the entry of the foot-receiving compartment between open and closed positions and fasteners are provided for releasably securing the upper second portion in the closed position. The shoe may be displayed on a support in the form of a headless animal, wherein the shoe is positionable on the support such that the addition of the shoe creates the appearance of a completed animal. This prior art patent does not disclose or teach the method of manufacturing the mask slipper of the present invention.

U.S. Pat. No. 6,276,074 to MARTIN discloses a slipper in combination with a hand puppet. The slipper comprises a sole and an associated upper attached to the sole and forming therewith a foot pocket having an inlet opening for reception of a person foot. Decorations is provided on the upper representing a puppet character such as a head. Either a set of finger slots or a pocket is provided in the sole so that a person, by inserting their fingers into the slots or by insertion of their hand into the pocket, can manipulate the puppet character in the manner of a glove puppet. This prior art patent does not disclose or teach the method of manufacturing the mask slipper of the present invention.

None of the prior art patents teach or disclose the particular method of making the mask slipper of the present invention that includes the attachment of an outer latex layer, which forms a mask, to the upper front section of the mask slipper.

Accordingly, it is an object of the present invention to provide a method of manufacturing a mask slipper that includes the attachment of an outer latex layer, which forms a mask, to the upper foot section of the mask slipper.

Another object of the present invention is to provide a mask slipper that includes a mask section that is in the form of an animal, a human, a cartoon character, a bird, a fish and the like.

Another object of the present invention is to provide a mask slipper that includes a mask section that is made from materials selected from the group consisting of cotton, cotton-polyester, leather, fur, faux fur, linen, rayon, nylon, latex, plastic and the like.

A further object of the present invention is to provide a method of manufacturing of a mask slipper that can be mass produced in an automated and economical manner and the mask slipper is readily affordable by the consumer.

SUMMARY OF THE INVENTION

In accordance with the present invention, there is provided a method of making a mask slipper, comprising the steps of: forming a mask from a material selected from the group consisting of plastic, latex and fabric; forming a composite sole member having a first layer of inner filler material; forming a composite upper member having a second layer of inner filler material, an outer surface for receiving the mask, and an inner surface for receiving an inner lining. The method of making the mask slipper further includes the steps of attaching the mask to the outer surface of the composite upper member; attaching the inner lining to the inner surface of the composite upper member; attaching the composite sole member to the composite upper member to form the mask slipper; and turning of the mask slipper such that a correct outer side is on the outside of the formed mask slipper.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

The mask slipper 10 and its component parts of the preferred embodiment of the present invention are represented in detail in FIG. 1 through 9 of the patent drawings. The mask slipper 10 is used by children, teens and adults for casual wear in one's home.

Figure 1:
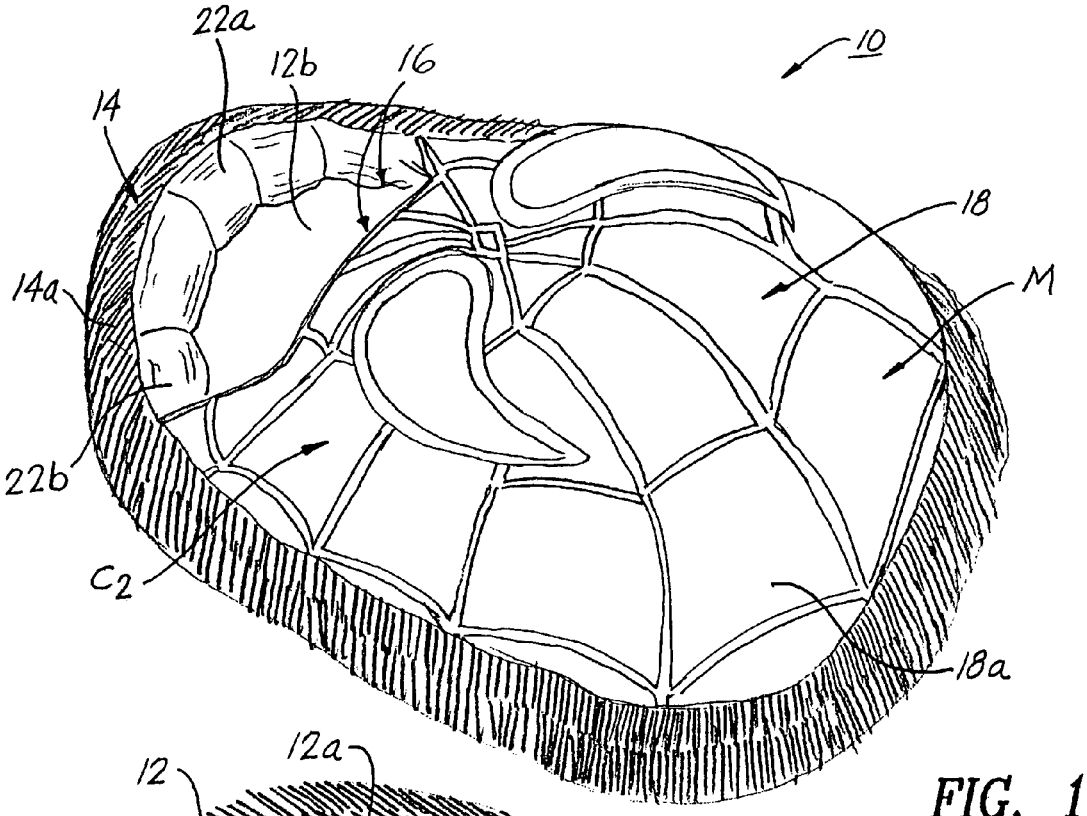
FIG. 1 is a top perspective view of the mask slipper of the preferred embodiment of the present invention showing the mask slipper in its assembled configuration.
Figure 2:
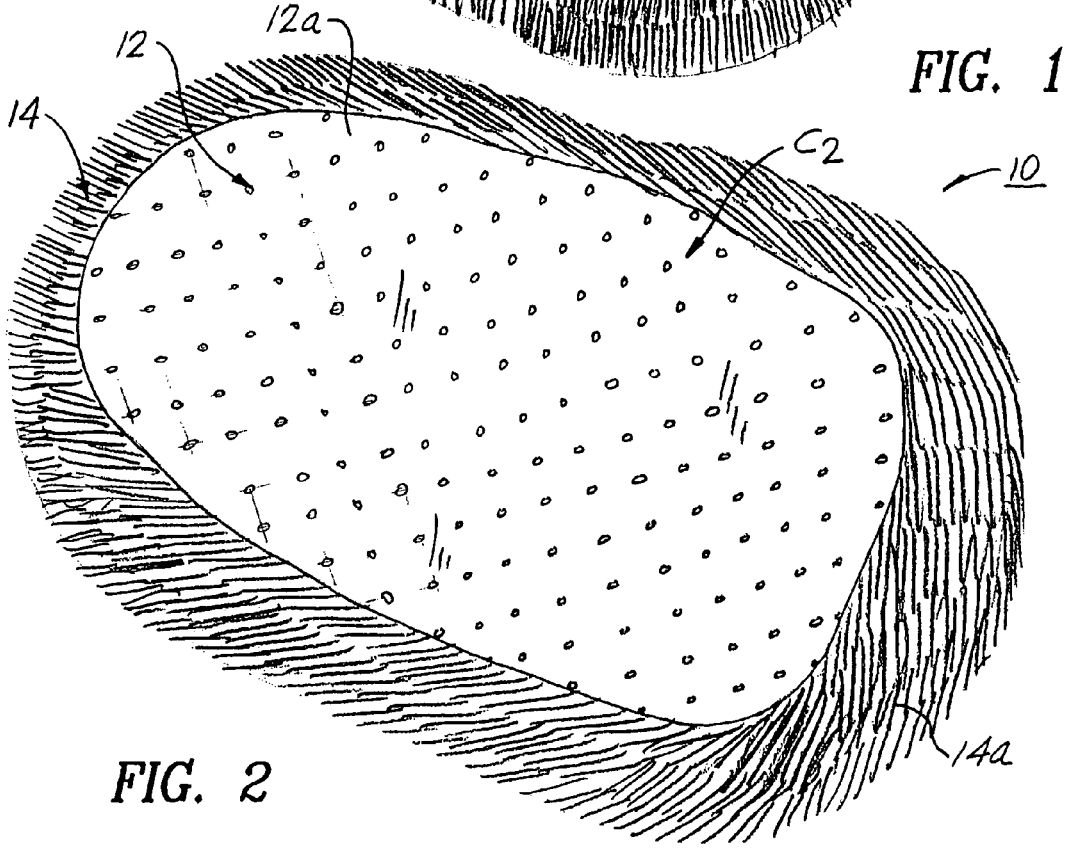
FIG. 2 is a bottom perspective view of the mask slipper of the present invention showing a sole section attached to an outer layer section.
Figure 3:
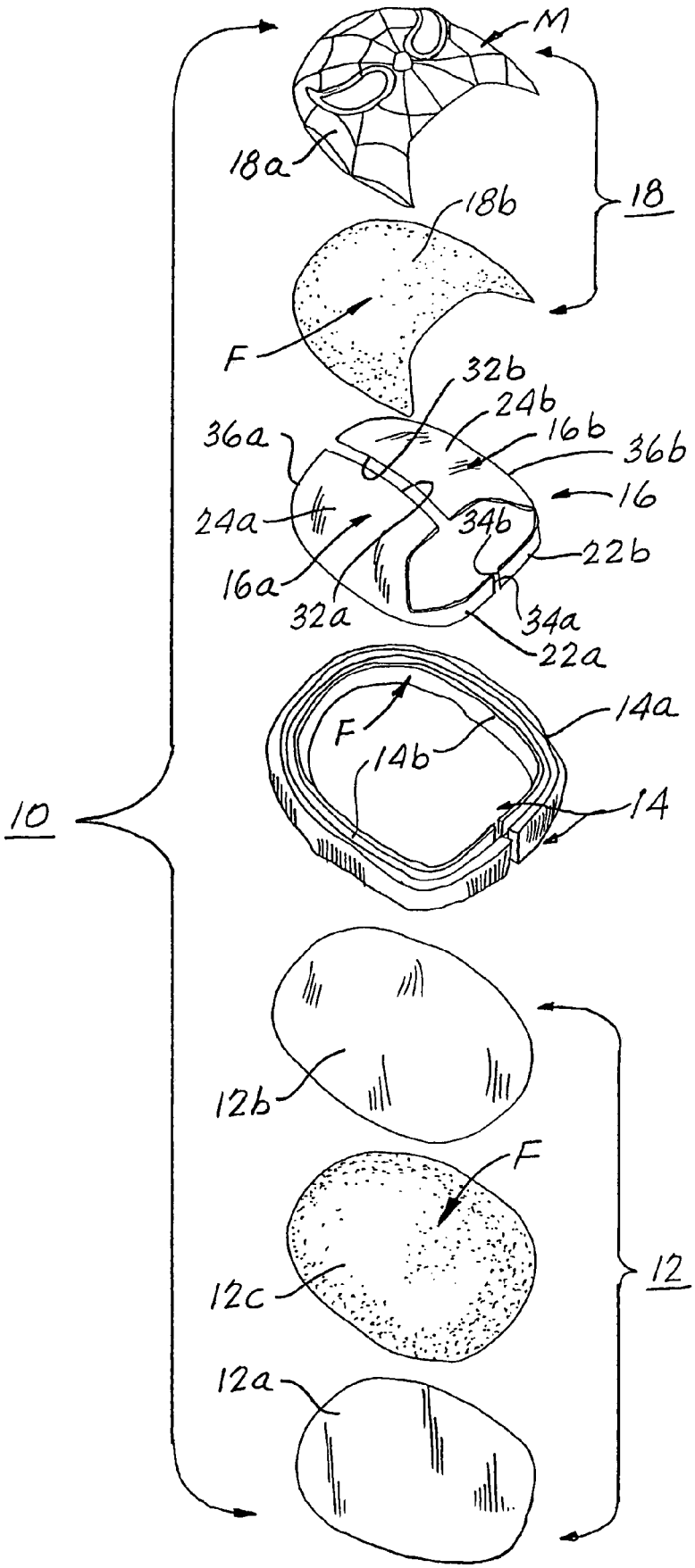
FIG. 3 is an exploded perspective view of the mask slipper of the present invention showing the major component parts of the unassembled configuration of the mask slipper.

As shown in FIGS. 1 to 3, the mask slipper 10 includes a sole section 12, an outer layer section 14, an inner lining section 16 and an upper foot section 18. The sole section 12 includes a lower sole layer 12*a*, an upper sole inner lining 12*b*, and a sole filler material layer 12*c* disposed between layers 12*a* and 12*b*. The outer layer section 14 includes an outer material layer 14*a* and a filler material layer 14*b*. The outer material layer 14*a* may be made from materials selected from the group consisting of cotton, cotton-polyester, leather, fur, faux fur, linen, rayon, nylon and the like.

Figure 4:
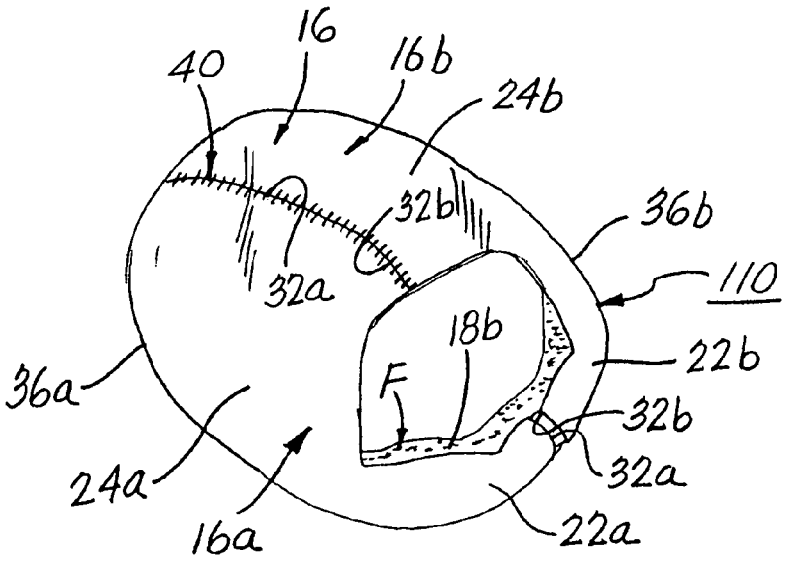
FIG. 4 is a perspective view of the mask slipper of the present invention showing an inner lining section sewn to an upper foot section to form a first upper composite section.
Figure 8:
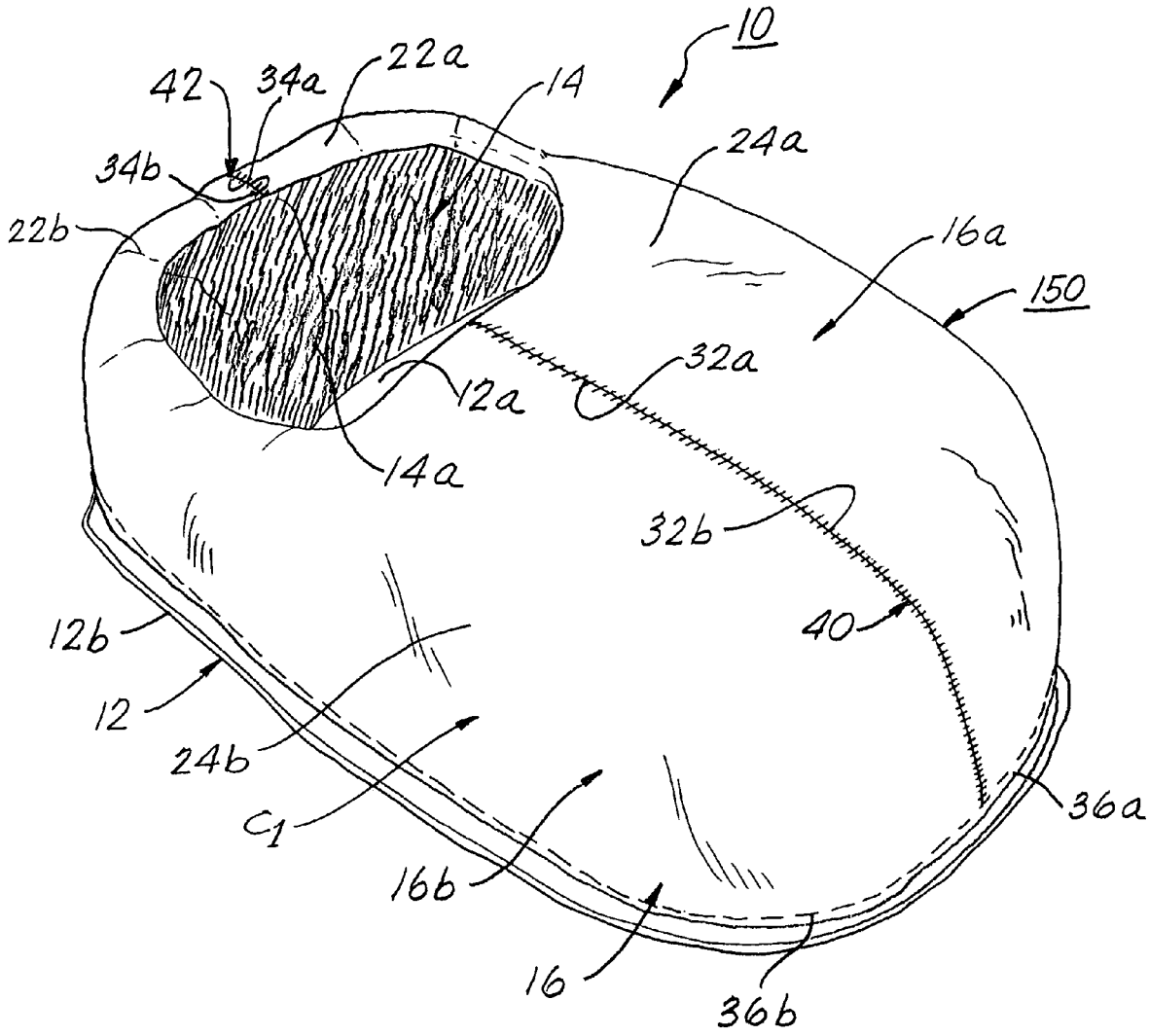
FIG. 8 is a perspective view of the mask slipper of the present invention showing the lower sole composite section sewn to the third upper composite section to form a mask slipper composite being in an inside-out configuration

The inner lining section 16 includes a first lining section 16*a* which partially surrounds the outer portion 22*a* and partially covers half of the upper foot area 24*b* of a wearer's foot 20, and a second lining section 16*b* which partially surrounds the other section of the outer portion 22*b* and partially covers the other half of the upper foot area 24*b* of the wearer's foot 20, as depicted in FIG. 3 of the drawings. The first lining section 16*a* includes a first sewing perimeter edge 32*a*, a second sewing perimeter edge 34*a*, and a third sewing perimeter edge 36*a*. The second lining section 16*b* includes a first sewing perimeter edge 32*b*, a second sewing perimeter edge 34*b*, and a third sewing perimeter edge 36*b*. Each of the first sewing perimeter edges 32*a* and 32*b* are sewn together, and each of the second sewing perimeter edges 34*a* and 34*b* of the first and second lining sections 16*a* and 16*b* are sewn together to form seams 40 and 42 for forming the inner lining section 16, as shown in FIGS. 3, 4 and 8 of the drawings.

Figure 5:
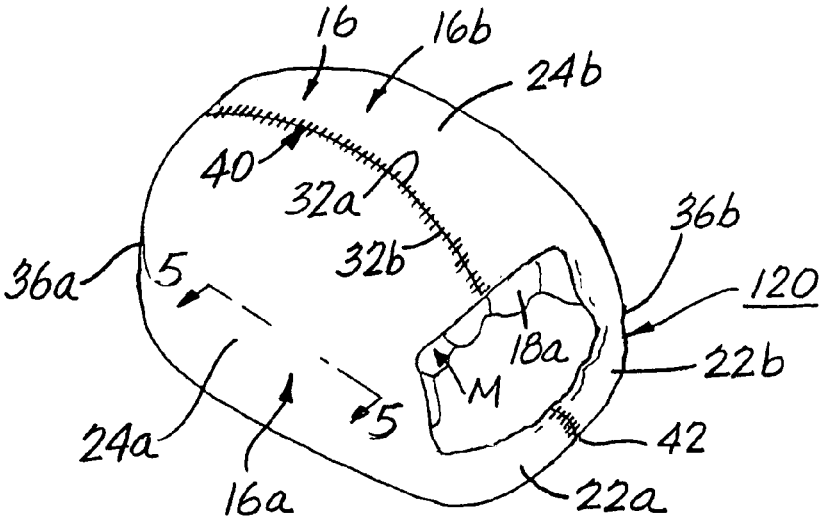
FIG. 5 is a perspective view of the mask slipper of the present invention showing an outer latex layer (mask section) of the upper foot section sewn to the first upper composite section to form a second upper composite section.

The upper foot section 18 includes an outer latex layer 18*a* which forms a mask M on the upper foot area 24 of the wearers' foot 20, and a mask filler material layer 18*b* disposed between layers 16*b* and 18*a*, as depicted in FIGS. 1, 3 and 5 of the drawings. The mask section M may be in the form of an animal, a human, a cartoon character, a bird, a fish or the like. The mask section M may be made from materials selected from the group consisting of latex, cotton, cotton-polyester, leather, fur, faux fur, linen, rayon, nylon, moldable plastic and the like. The filler material layers 12*c*, 14*b* and 18*b* are made from polyester fiber fill F, as depicted in FIG. 3 of the drawings.

Method of Manufacturing 100 of the Mask Slipper 10

Figure 10A:
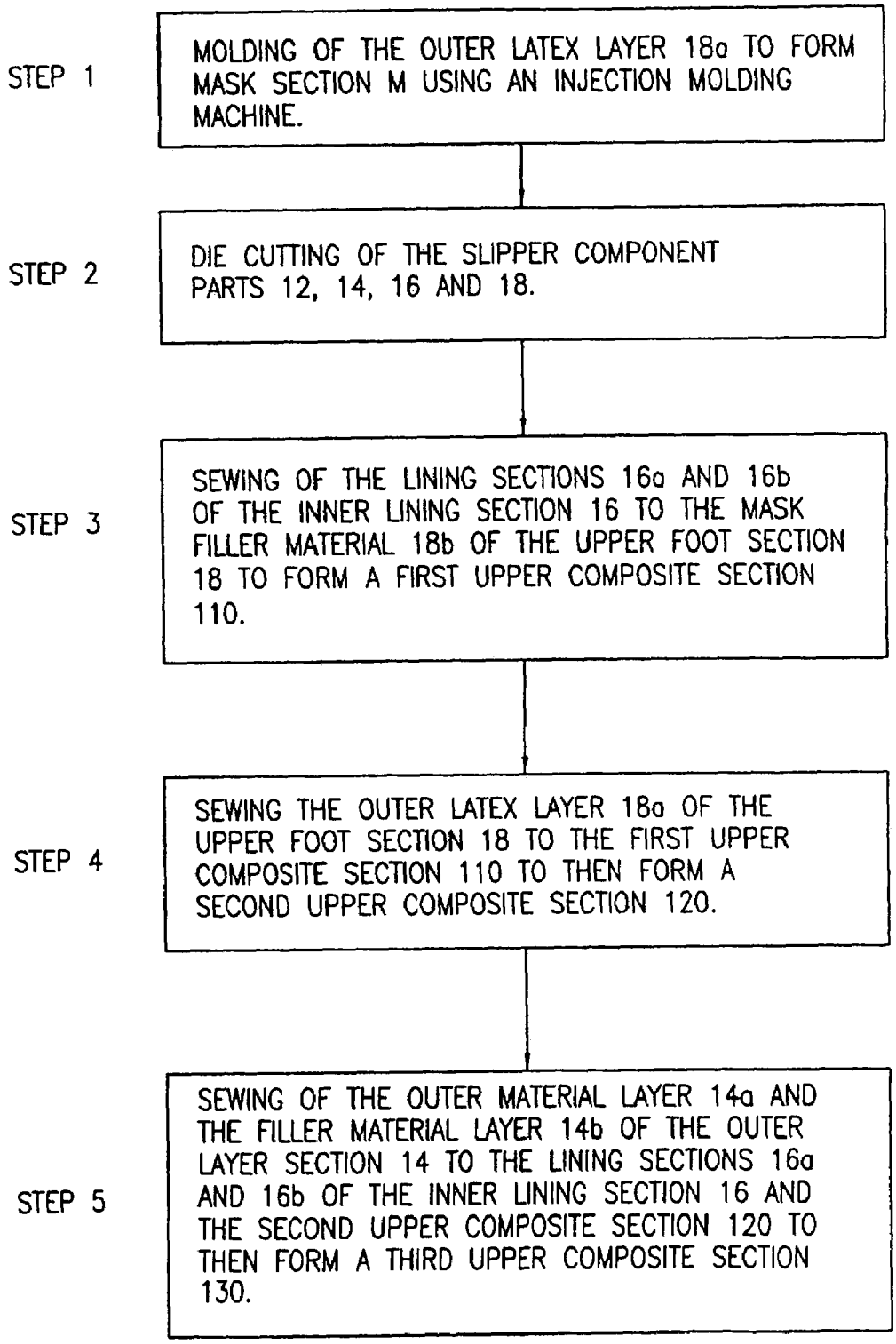
FIG. 10A is a schematic representation of the method of manufacturing of the mask slipper of the present invention showing the component steps 1 through 5 that are necessary to form the mask slipper.
Figure 10B:
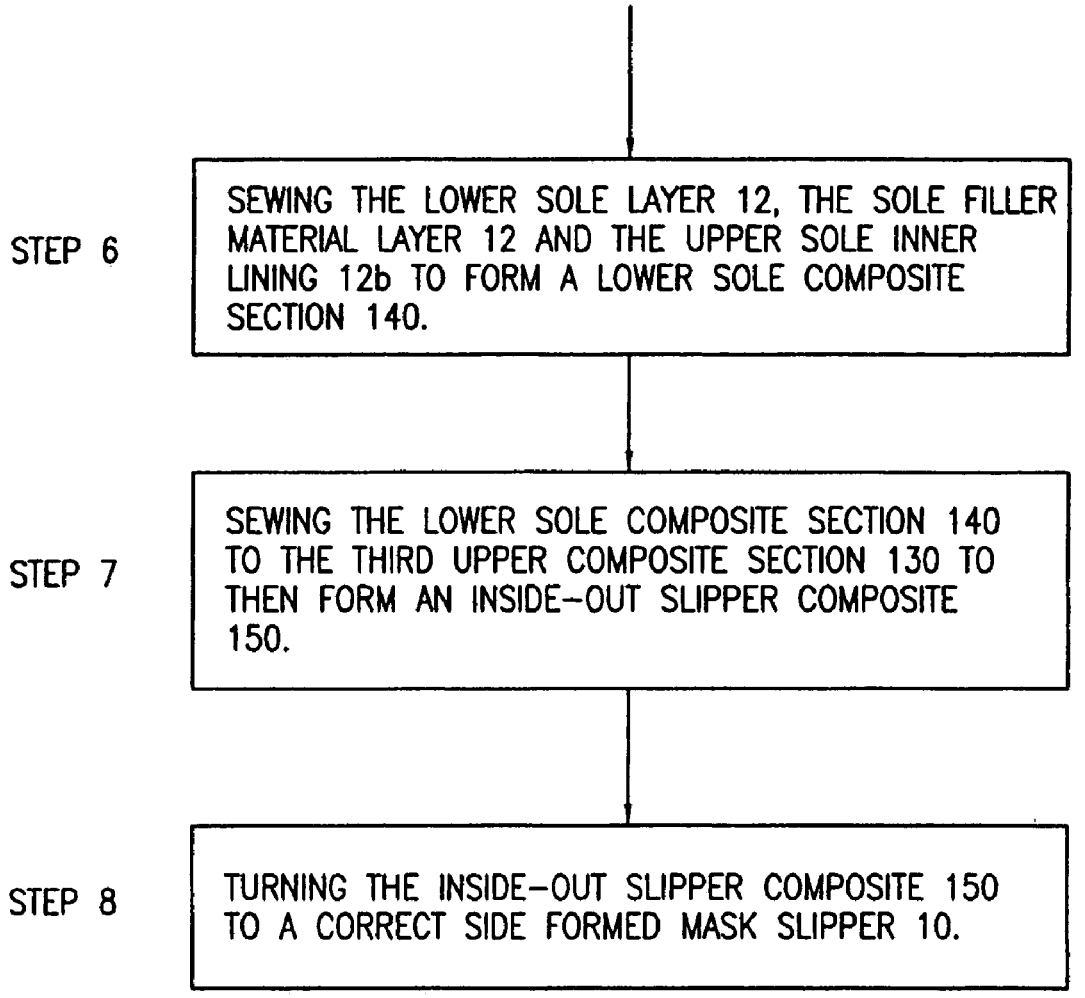
FIG. 10B is a schematic representation of the method of manufacturing of the mask slipper of the present invention showing the component steps 6 through 8 that are necessary to form the mask slipper.

The method of manufacturing the mask slipper 10, as shown in FIG. 10, includes the following steps of assembly 100:

STEP 1: The outer latex layer 18*a* is molded to form a mask section M using an injection molding machine.

STEP 2: All of the slipper component parts 12, 14, 16 and 18 are die cut from appropriate materials assigned to the above mentioned component parts 12, 14, 16 and 18, as shown in FIG. 3.

STEP 3: The first and second lining sections 16*a* and 16*b* of the inner lining section 16 and the mask filler material layer 18*b* of the upper foot section 18 are then sewn together to form a first upper composite section 110, as shown in FIG. 4.

Figure 5A:
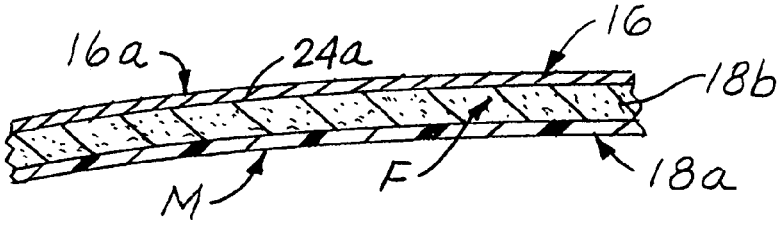
FIG. 5A is a cross-sectional view of the mask slipper of the present invention taken along lines 5A—5A of FIG. 5 showing the inner lining, a filler material layer and the latex layer that form the second upper composite section.

STEP 4: The outer latex layer 18*a* (mask section M) of the upper foot section 18 is then sewn to the first upper composite section 110 to form a second upper composite section 120, as shown in FIGS. 5 and 5A.

Figure 6:
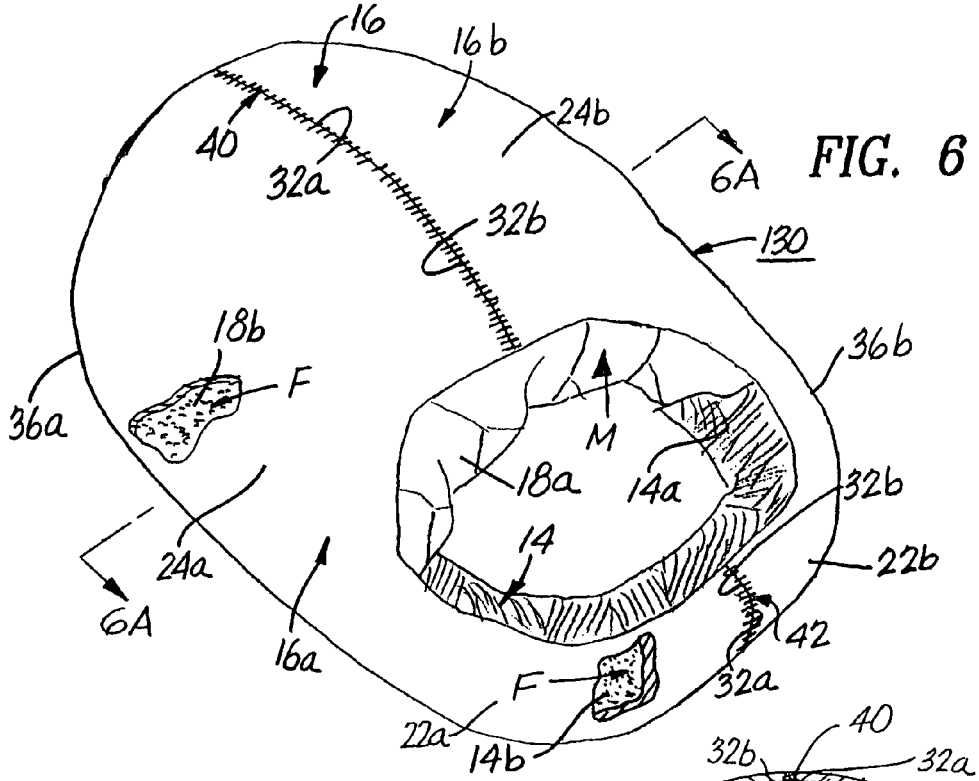
FIG. 6 is a perspective view of the mask slipper of the present invention showing an outer material layer and a filler material layer of the outer layer section being sewn to a first lining section of the inner lining section and being connected to the second upper composite section to form a third upper composite section.
Figure 6A:
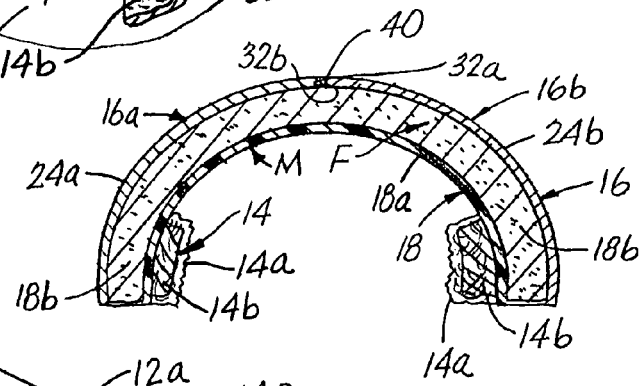
FIG. 6A is a cross-sectional view of the mask slipper of the present invention taken along lines 6A—6A of FIG. 6 showing the component layers that form the third upper composite section.

STEP 5: The outer material layer 14*a* and the filler material layer 14*b* of the outer layer section 14 are then sewn to the first and second lining sections 16*a* and 16*b* of the inner lining section 16 and the second upper composite section 120 to then form a third upper composite section 130, as shown in FIGS. 6 and 6A.

Figure 7:
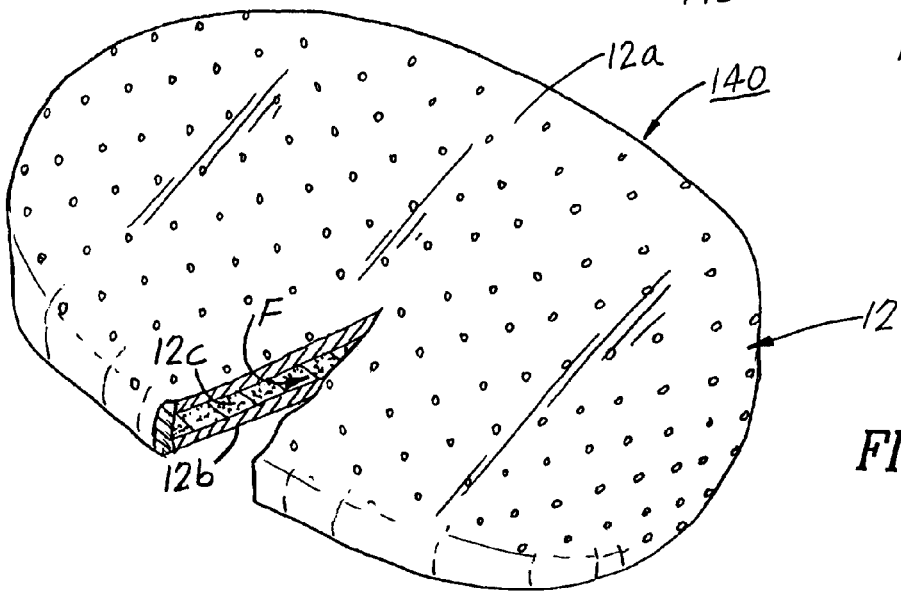
FIG. 7 is a perspective view of the mask slipper of the present invention showing a lower sole layer, a sole filler material layer and an upper sole inner lining sewn together to form a lower sole composite section.

STEP 6: The lower sole layer 12*a*, the sole filler material layer 12*c* and the upper sole inner lining 12*b* of the sole section 12 are then sewn together to form a lower sole composite section 140, as shown in FIG. 7.

STEP 7: The lower sole composite section 140 (consisting of layers 12*a*, 12*c* and 12*b*) is then sewn to the third upper composite section 130 (consisting of layers 14*a*, 14*b*, 16, 18*a* and 18*b*) to then form a slipper composite 150 being in an inside out configuration $C_1$, as shown in FIG. 8.

Figure 9:
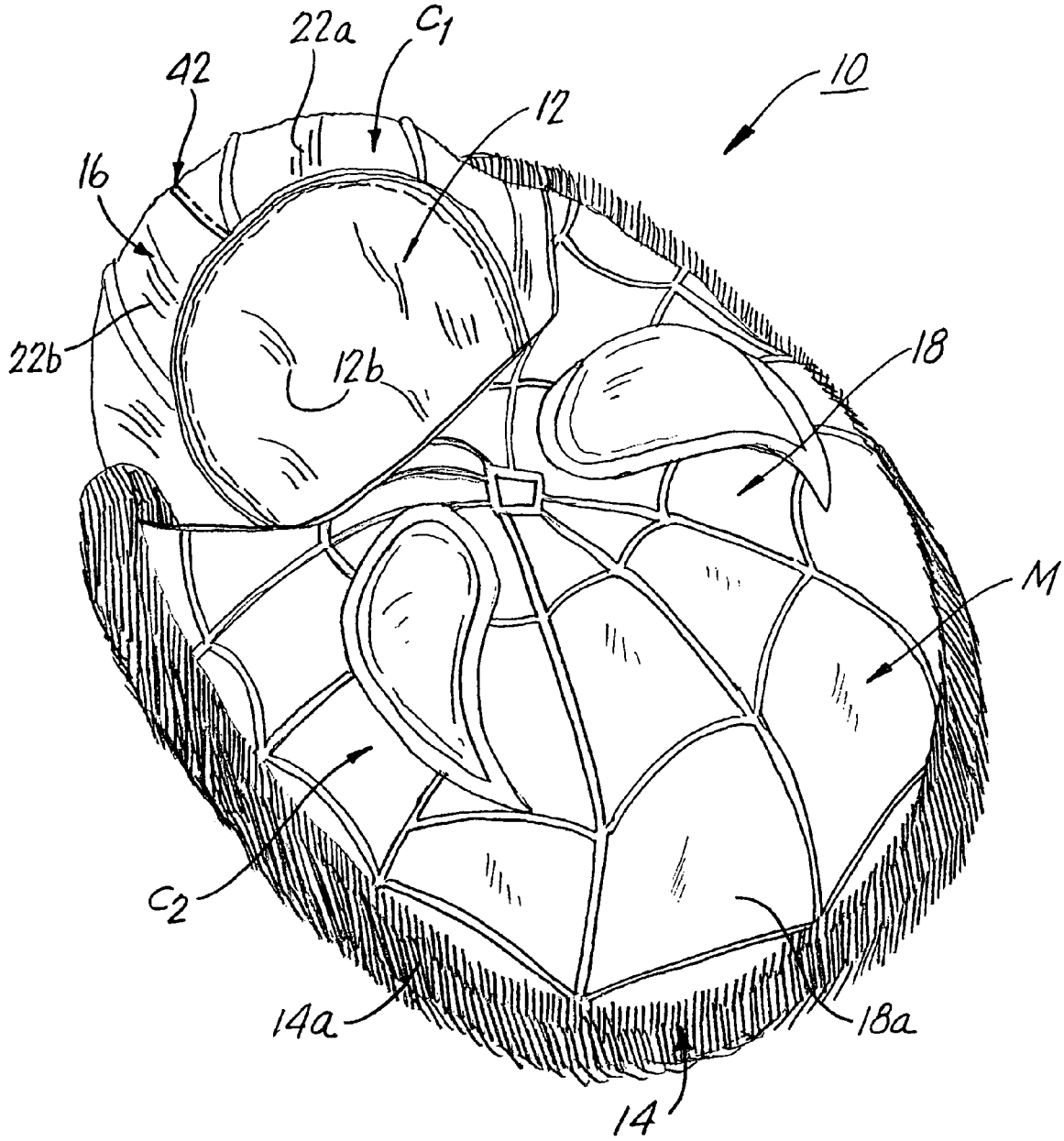
FIG. 9 is a perspective view of the mask slipper of the present invention showing the slipper composite being turned such that the correct side is on the outside of the formed mask slipper.

STEP 8: The inside out configuration $C_1$ of the sock composite 150 is then turned so that the correct side configuration $C_2$ is on the outside of the formed mask slipper 10, as shown in FIG. 9.

ADVANTAGES OF THE PRESENT INVENTION

Accordingly, an advantage of the present invention is that it provides for the method of manufacturing a mask slipper that includes the attachment of an outer latex layer, which forms a mask, to the upper foot section of the mask slipper.

Another advantage of the present invention is that it provides for a mask slipper that includes a mask section that is in the form of an animal, a human, a cartoon character, a bird, a fish and the like.

Another advantage of the present invention is that it provides for a mask slipper that includes a mask section that is made from materials selected from the group consisting of cotton, cotton-polyester, leather, fur, faux fur, linen, rayon, nylon, latex, plastic and the like.

A further advantage of the present invention is that it provides for a method of manufacturing of a mask slipper that can be mass produced in an automated and economical manner and the mask slipper is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of making a mask slipper, comprising the steps of:

a) forming a mask from a material selected from the group consisting of plastic, latex or fabric;

b) forming a composite sole member having a first layer of inner filler material;

c) forming a composite upper member having a second layer of inner filler material, an outer surface for receiving said mask, and an inner surface for receiving an inner lining thereon, and having perimeter edge for having said composite upper member attached thereto;

d) forming said inner lining in said composite upper member;

e) attaching said mask to said outer surface of said composite upper member;

f) attaching said inner lining to said inner surface of said composite upper member;

g) attaching an outer layer section having an outer material layer and an inner filler layer for connecting to said perimeter edge of said outer surface of said composite upper member;

h) attaching said composite sole member to said perimeter edge of said composite upper member to form said mask slipper; and i) turning of said mask slipper such that a correct outer side is on the outside of said formed mask.

2. A method of making a mask slipper in accordance with claim 1, further including the step of:

a) molding said mask from latex material using an injection molding apparatus.

3. A method of making a mask slipper in accordance with claim 1, further including the step of:

a) molding said mask from moldable plastic material using an injection molding apparatus.

4. A method of making a mask slipper in accordance with claim 1, further including the step of:

a) fabricating said mask from fabric materials selected from the group consisting of cotton, cotton-polyester, leather, fur, faux fur, linen, rayon, nylon and combinations thereof; and b) sewing said mask to said outer surface of said composite upper member.

5. A method of making a mask slipper in accordance with claim 1, further including the step of:

a) inserting and filling said composite sole member with said first layer of inner filler material, said first layer of inner filler material being made from polyester fill material; and b) disposing said first layer of said polyester fill material between a lower sole layer and an upper sole inner lining of said composite sole member.

6. A method of making a mask slipper in accordance with claim 1, further including the step of:

a) inserting and filling an interior space between said outer layer section and said outer surface of said composite with said second layer of said inner filler material.

* * * * *